US007527537B2

(12) United States Patent
Mizutani

(10) Patent No.: US 7,527,537 B2
(45) Date of Patent: May 5, 2009

(54) ELECTRIC TYPE STEERING DEVICE FOR OUTBOARD MOTORS

(75) Inventor: Makoto Mizutani, Hamamatsu (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/593,393

(22) Filed: Nov. 6, 2006

(65) Prior Publication Data

US 2007/0105463 A1 May 10, 2007

(30) Foreign Application Priority Data

Nov. 4, 2005 (JP) ..... 2005-320897

(51) Int. Cl.

| | |
|---|---|
| ***B63H 5/20*** | (2006.01) |
| ***B63H 5/125*** | (2006.01) |
| ***B63H 20/08*** | (2006.01) |
| *B63H 21/22* | (2006.01) |
| *B63H 23/00* | (2006.01) |
| *G05D 1/02* | (2006.01) |

(52) U.S. Cl. ..... 440/53; 440/1; 440/61 S; 440/63; 114/144 E

(58) Field of Classification Search ..... 440/53, 440/61 S, 1, 63; 114/144 E
See application file for complete search history.

(56) References Cited

U.S. PATENT DOCUMENTS

| | | | |
|---|---|---|---|
| 2,215,003 | A | 9/1940 | Johnson |
| 2,224,357 | A | 12/1940 | Pecker |
| 3,084,657 | A | 4/1963 | Kiekhaefer |
| 3,233,691 | A | 2/1966 | De Biasi |
| 3,310,021 | A | 3/1967 | Shimanckas |
| 3,349,744 | A | 10/1967 | Mercier et al. |

(Continued)

FOREIGN PATENT DOCUMENTS

JP 62-166193 * 7/1987

(Continued)

OTHER PUBLICATIONS

Co-Pending U.S. Patent Application, filed Oct. 25, 2006. Title: Control Unit for Multiple Installation of Propulsion Units.

(Continued)

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

A steering device can include a steering wheel, connecting members for connecting outboard motors together, and a plurality of steering motors for steering a plurality of outboard motors. A target steering angle setting device can be configured to obtain a steering angle according to a steering displacement of the steering wheel, and steering unit angle sensor can be configured to detect actual steering unit angles of the respective outboard motors. A correcting device can be configured to obtain the difference between actual steering unit angles of the outboard motors, to correct the target steering angles based on the difference, and to obtain a target steering angle of each of the outboard motors. Motor controlling device can be configured to control the steering motors so that a target steering angle agrees with the actual steering unit angle for each of the outboard motors.

16 Claims, 12 Drawing Sheets

U.S. PATENT DOCUMENTS 4,120,258 A 10/1978 Spurgin
4,220,111 A 9/1980 Krautkremer et al.
4,373,920 A 2/1983 Hall et al.
4,500,298 A 2/1985 Hall et al.
4,519,335 A 5/1985 Krautkremer et al.
4,637,802 A * 1/1987 Taguchi et al. ..... 440/75
4,787,867 A 11/1988 Takeuchi et al.
4,872,857 A 10/1989 Newman et al.
4,908,766 A 3/1990 Takeuchi
4,909,765 A 3/1990 Riske et al.
5,029,547 A 7/1991 Novey
5,031,562 A 7/1991 Nakase et al.
5,231,888 A 8/1993 Katahira
5,235,927 A 8/1993 Singh et al.
5,244,426 A 9/1993 Miyashita et al.
5,253,604 A 10/1993 Bohlin
5,361,024 A 11/1994 Wisner et al.
5,370,564 A 12/1994 Fujimoto et al.
5,533,935 A 7/1996 Kast
5,800,223 A * 9/1998 Iriono et al. ..... 440/49
5,997,370 A 12/1999 Fetchko et al.
6,079,513 A 6/2000 Nishizaki et al.
6,230,642 B1 5/2001 McKenney et al.
6,234,853 B1 5/2001 Lanyi et al.
6,273,771 B1 8/2001 Buckley et al.
6,402,577 B1 6/2002 Treinen et al.
6,405,669 B2 6/2002 Rheault et al.
6,471,556 B1 10/2002 Yamashita et al.
6,511,354 B1 1/2003 Gonring et al.
6,535,806 B2 3/2003 Millsap et al.
6,561,860 B2 * 5/2003 Colyvas ..... 440/59
6,655,490 B2 12/2003 Andonian et al.
6,671,588 B2 12/2003 Otake et al.
6,678,596 B2 1/2004 Husain et al.
6,843,195 B2 1/2005 Watabe et al.
6,855,014 B2 2/2005 Kinoshita et al.
6,892,661 B2 5/2005 Kishi et al.
6,892,662 B2 5/2005 Watanabe et al.
6,994,046 B2 2/2006 Kaji et al.
6,997,763 B2 2/2006 Kaji
7,004,278 B2 2/2006 Sugitani et al.
7,063,030 B2 6/2006 Mitzutani
7,311,572 B2 * 12/2007 Yamashita et al. ..... 440/63
2003/0077953 A1 4/2003 Kaji
2003/0150366 A1 8/2003 Kaufmann et al.
2003/0224670 A1 12/2003 Takada et al.
2003/0224672 A1 12/2003 Takada et al.
2004/0007644 A1 1/2004 Phelps et al.
2004/0031429 A1 2/2004 Kaufmann et al.
2004/0121665 A1 6/2004 Mizuguchi et al.
2004/0139902 A1 7/2004 Takada et al.
2004/0139903 A1 7/2004 Watabe et al.
2005/0118894 A1 * 6/2005 Kawanishi ..... 440/1
2005/0121975 A1 6/2005 Gronau et al.
2005/0170712 A1 8/2005 Okuyama
2005/0170713 A1 8/2005 Okuyama
2005/0199167 A1 9/2005 Mizutani
2005/0199168 A1 9/2005 Mizutani
2005/0199169 A1 9/2005 Mizutani
2005/0215131 A1 9/2005 Oguma et al.
2005/0282447 A1 12/2005 Okuyama
2006/0019558 A1 * 1/2006 Mizutani
2006/0037522 A1 2/2006 Kaneko et al.
2006/0166567 A1 * 7/2006 Otobe et al. ..... 440/1
2006/0180070 A1 8/2006 Mizutani
2006/0217012 A1 9/2006 Mizutani
2007/0049139 A1 * 3/2007 Mizutani
2007/0066157 A1 * 3/2007 Yamashita et al. ..... 440/63

FOREIGN PATENT DOCUMENTS

JP 01-314695 * 12/1989
JP 02-179597 7/1990
JP 02-227395 9/1990
JP 03148395 A * 6/1991
JP 04-038297 2/1992
JP 04038297 A * 2/1992
JP B-HEI 6-33077 5/1994
JP 2739208 B2 1/1998
JP 10-226346 8/1998
JP A-HEI 10-310074 * 11/1998
JP 2959044 B2 7/1999
JP 2000-318691 11/2000
JP 2003-313398 11/2000
JP 3232032 * 9/2001
JP A-2002-331948 11/2002
JP A-2004-155282 * 6/2004
JP 2005-254848 9/2005

OTHER PUBLICATIONS

Co-Pending U.S. Appl. No. 11/515,600, filed Sep. 5, 2006. Title: Steering System for a Small Boat.
Co-pending U.S. Appl. No. 11/942,179, filed Nov. 19, 2007. Title: Watercraft Steering Device and Watercraft.
Co-pending U.S. Appl. No. 11/942,187, filed Nov. 19, 2007. Title: Watercraft Steering System, and Watercraft.
Co-pending U.S. Appl. No. 11/942,159, filed Nov. 19, 2007. Title: Watercraft Steering Device and Watercraft.
Co-Pending U.S. Appl. No. 11/516,151, filed Sep. 5, 2006. (submitted herewith) Title: Steering Method and Steering System for Boat.*

* cited by examiner

ELECTRIC TYPE STEERING DEVICE FOR OUTBOARD MOTORS

PRIORITY INFORMATION

This application is based on and claims priority under 35 U.S.C. §119 to Japanese Patent Application No. 2005-320897, filed on Nov. 4, 2005, the entire contents of which is hereby expressly incorporated by reference herein.

BACKGROUND OF THE INVENTIONS

1. Field of the Inventions

The present inventions relate to a steering device for marine propulsion systems, and more particularly, to an electric type steering devices for outboard motors.

2. Description of the Related Art

Some known steering devices for outboard motors, such as those for steering a plurality of outboard motors, for instance, are the type disclosed in Japanese Patent Documents JP-B-2734041 (FIG. 1) and JP-A-Hei 8-276896 (FIG. 2).

In the steering system disclosed in Japanese Patent Documents JP-B-2734041, two outboard motors are steered by one steering wheel in the associated steering device. This steering device is constructed with a connecting member for connecting the outboard motors together so that steering movements of both the outboard motors are linked together and wires and the like for transmitting a steering force from the steering wheel are connected to this connecting member.

Two outboard motors, which can be controlled with a steering device such as the type disclosed in Japanese Patent Documents JP-B-2734041, as shown in FIG. 16(*a*), are configured such that the rotational directions of propellers 100 are opposite to each other. In common outboard motors, it is known that, when the propeller 100 rotates in water, a force F pushing the propeller 100 in a horizontal direction is produced due to a difference between the water pressures applied on the propeller 100 from above and below a propeller shaft 101, as illustrated in FIG. 16(*a*).

These forces F in the horizontal directions are, as shown in FIG. 17(*a*), cancelled when two outboard motors 102 are arranged such that the rotational directions of their propellers 100 are opposite to each other and are connected together by a connecting member 103. That is, with this configuration, transmission of the force F to the steering wheel is prevented.

The steering device for outboard motors disclosed in Japanese Patent Document JP-A-Hei 8-276896 (FIG. 2) is configured such that one of the two outboard motors connected together by the mentioned connecting member is steered by a hydraulic pressure (oil) cylinder. This oil cylinder is connected to a master cylinder provided on the steering wheel via a hydraulic pressure circuit.

This connecting member disclosed in Japanese Patent Document JP-A-Hei 8-276896 connects a steering bracket of each outboard motor to each other. This connecting member is constructed such that a plurality of links is combined to prevent an application of an excessive force on the connection part between the outboard motors and the connecting member when a trim angle of one of the outboard motors is changed to an angle different from the angle of the other outboard motor.

In the steering devices for outboard motors disclosed in Japanese Patent Documents JP-B-2734041 (FIG. 1) and JP-A-Hei 8-276896 (FIG. 2), members for connecting the steering wheel side and the outboard motor sides (wires and hydraulic pipes) need to be made to conform with the shapes and sizes of hulls. This kind of problem is solved by a use of an electric motor as an actuator for steering an outboard motor.

For example, There is a steering device for an outboard motor with an electric motor, for example, the one described in Japanese Patent Document JP-B-2959044 (FIG. 3). In this steering device, one outboard motor is steered by an electric motor. In this configuration, rotation of the electric motor is converted into reciprocating motions by a rack and pinion, and the reciprocating motions are transmitted to a steering bracket of the outboard motor. The electric motor is connected to a control device, and rotations of this electric motor are controlled to correspond to the rotational direction and rotating angle of the steering wheel by the control device.

Because the steering wheel side and the outboard motor side can be connected by electric wires in an electric type steering device for outboard motors configured in such a manner, its installation is easier comparing with the case that wires and hydraulic pipes and the like for mechanically transmitting steering forces are used.

In the case that a plurality of outboard motors is steered by the electric type steering device described in Japanese Patent Document JP-B-2959044 (FIG. 3) mentioned above, it is desirable to use a plurality of electric motors for high durability and reliability.

In the case that a plurality of outboard motors is steered by a plurality of electric motors, the motor, rack and pinion of the steering device is installed on each outboard motor.

SUMMARY OF THE INVENTIONS

An aspect of at least one of the embodiments disclosed herein includes the realization that the consumption of electric power by plural electric motors, one driving each of a plurality of outboard motors connected together. This condition emerges conspicuously, for example, in the case that the lengths of the connecting members are different from their designed lengths due to production errors and/or other causes.

For example, as shown in FIG. 17(*b*), in the case that a length of the connecting member 103 is larger than the designed length and an actual steering unit angle of one outboard motor 102A is dislocated from a target steering angle, the electric steering motor, the other outboard motor 102B where its actual steering unit angle agrees with its target steering angle operates correctly. However, the electric steering motor of the outboard motor 102A where its actual steering unit angle is dislocated from its target steering angle, cannot steer the outboard motor 102A to the predetermined steering angle, and thus continues to operate possibly resulting in overheating or overload.

In the case where a plurality of outboard motors is steered by a plurality of electric motors and a trim angle is changeable on each of the outboard motors, a connecting member for connecting the outboard motors together configured with a multiple use of links such as the one disclosed in Japanese Patent Document JP-A-Hei 8-276896 has to be used. This configuration is necessary because if the connecting member is constructed with a rod laid over between the steering brackets of the two outboard motors, the front part of one of the outboard motors is pulled to the side of the other outboard motor when a trim angle of either one of the outboard motors is changed, and an excessive stress is produced on the connecting parts between the connecting member and the outboard motors.

Some of the embodiments disclosed herein are directed to providing an electric type steering device for outboard motors such that a plurality of electric motors operates without overloading even if the length of the connecting member for connecting the outboard motors together changes. Additionally, some of the embodiments disclosed herein are directed to providing an electric type steering device for outboard motors such that, while using a connecting member with a simple configuration, an excessive stress is not produced on the connecting part between the connecting member and the outboard motors when a trim angle of one of a plurality of outboard motors is changed.

Thus in accordance with an embodiment, an electric type steering device for a plurality outboard motors, comprising a steering wheel, and a connecting member for connecting outboard motors together so that the steering movements of a plurality of outboard motors are linked together. A plurality of electric steering motors can be configured to steer the plurality of outboard motors and a target steering angle setting device can be configured to obtaining a target steering angle according to a steering displacement of the steering wheel and an actual steering unit angle detecting device configured to detecting an actual steering unit angle of each of the outboard motors. A correcting device can be configured to obtain a difference between actual steering unit angles of at least two of the plurality of outboard motors, to correct a target steering angle of each outboard motor according to this difference, and to obtain a target steering angle of each outboard motor. Additionally, a motor controlling device can be configured to control the electric steering motor so that the target steering angle of each of the outboard motors agrees with the actual steering unit angle.

In accordance with another embodiment, an electric type steering device for a plurality of outboard motors can comprise a steering wheel, a connecting member connecting a plurality of outboard motors together so that the steering movements of the plurality of outboard motors are linked and a plurality of electric steering motors configured to steer the plurality of outboard motors. A target steering angle setting device can be configured to obtain a target steering angle according to a steering displacement of the steering wheel and an actual steering unit angle detecting device can be configured to detect an actual steering unit angle of a predetermined reference outboard motor of the plurality of outboard motors. Additionally, a motor controlling device can be configured to obtain a controlling steering angle which is the difference between an actual steering unit angle detected by the actual steering unit angle detecting device and the target steering angle, and to operate all electric steering motors only by the controlling steering angle.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
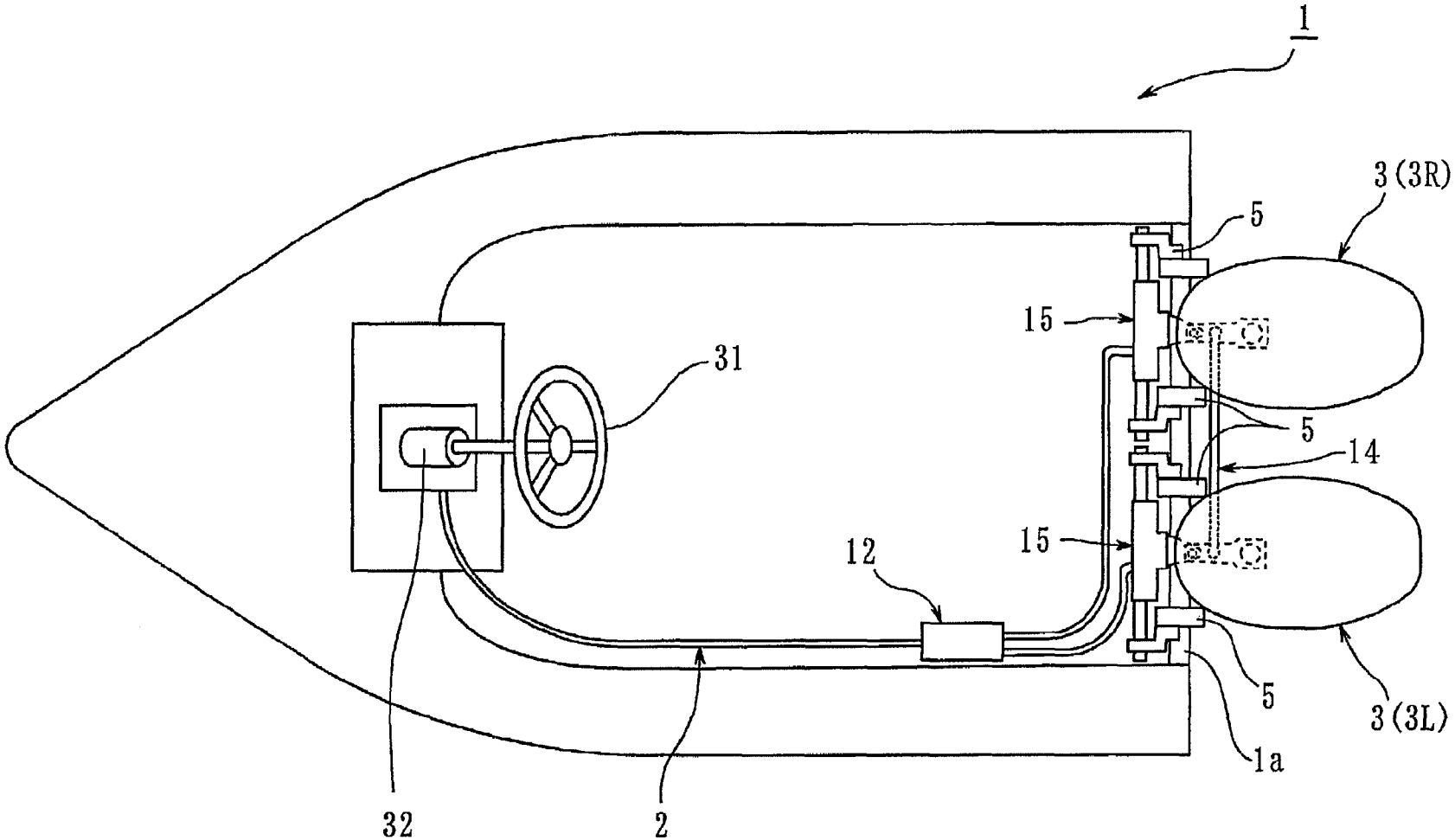
FIG. 1 is a schematic top plan view of a small watercraft equipped with an embodiment of an electric type steering device for outboard motors.

The embodiments of the electric type steering device disclosed herein are described in the context of a marine propulsion system, and in some embodiments, an array of outboard motors of a boat because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

In the figures, reference numeral 1 denotes a small watercraft equipped with an electric type steering device for outboard motors 2. This small watercraft 1 can be equipped with two outboard motors 3, and can be propelled by these outboard motors 3, 3.

The outboard motors 3, 3 can be configured such that the directions of the rotations of propellers 4 (see FIG. 3) are opposite to each other. The outboard motors 3, 3 can be installed on a stern board 1*a* (see FIG. 1) of the small watercraft 1 via clamp brackets 5 (see FIG. 2) and a swivel bracket 6 so that the outboard motors 3, 3 are disposed side by side in the width direction of the boat.

The clamp brackets 5 support the swivel bracket 6 such that the swivel bracket 6 can be rotatable in the vertical direction about a tilt shaft 7. The swivel bracket 6 supports a main body of the outboard motor 9 about a steering shaft 8 in a steerable manner.

The main body of the outboard motor 9 can include, although not shown in a figure, an engine, a casing having the propeller 4, and other devices. A trim angle adjusting device 11 for adjusting trim angle of the outboard motor 3 (see FIG. 3) can be provided between the clamp bracket 5 and the swivel bracket 6.

The trim angle adjusting device 11 can be configured such that the main body of the outboard motor 9 and the swivel bracket 6 are rotated together in the vertical direction around the tilt shaft 7 by a hydraulic cylinder (not shown) or electric motor (not shown) and/or other devices. The movements of the trim angle adjusting device 11 can be controlled by a controller 12 (see FIG. 3), described in greater detail below.

Figure 2:
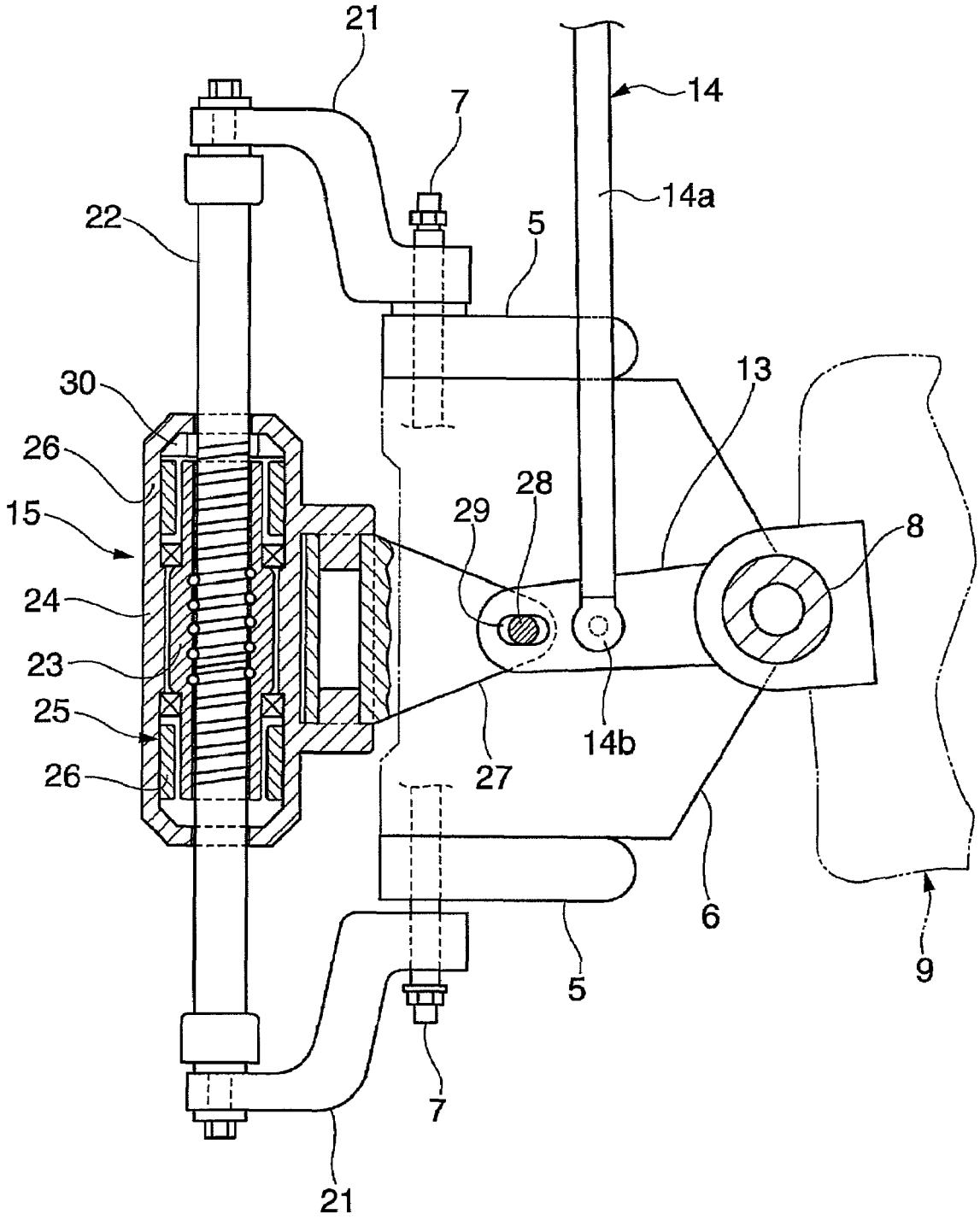
FIG. 2 is a cross-sectional view of a steering unit that can be used with the electric type steering device of FIG. 1.

As shown in FIG. 2, the steering bracket 13 projecting from the steering shaft 8 to the front section of the outboard motor 3 can be provided on the main body of the outboard motor 9. The main body of the outboard motor 9 can be steered respective to the swivel bracket 6 around the steering shaft 8 by swinging the steering bracket 13 in the horizontal direction. The steering brackets 13, 13 of the two outboard motors 3, 3 are, as shown in FIGS. 1 and 2, connected to each other by a connecting member 14, and connected to steering units 15 of the electric type steering device 2, described in greater detail below.

The connecting member 14 can be constructed with a so-called tie rod with ball joints 14*b* provided on both the ends of a rod 14*a*. The steering brackets 13 of both the outboard motors 3, 3 can be connected together by the connecting member 14, and thus the steering movements of both the outboard motors 3, 3 are linked. In addition, forces in the horizontal direction produced when the propellers 4, 4 rotate (propeller reaction force) are cancelled because the rotational directions of the propellers 4, 4 of both the outboard motors 3, 3 are opposite to each other.

The steering unit 15 can be, as shown in FIG. 2, constructed with a horizontal pair of supporting members 21 supported by the clamp brackets 5 about the tilt shafts 7 in a rotatable manner. A ball screw shaft 22 can extend between the supporting members 21, 21. A ball screw nut 23 can be threadedly engaged with the ball screw shaft 22. Additionally, a steering motor 25 having a housing 24 for accommodating the ball screw nut 23 can also be included in the steering unit. In some embodiments, one steering unit is provided on each of the outboard motors 3, 3.

The ball screw shaft 22 can be supported by the supporting member 21 so that the axis of the ball screw shaft 22 can be parallel to the width direction o the boat 1. The ball screw nut 23 can be supported in a rotatable manner in the housing 24 with its movement in the axial direction being restricted.

The steering motor 25 can be constructed such that the ball screw nut 23 rotates in the housing 24 by energizing the coil (not shown) of a stator 26 fixed in the housing 24. The rotation of this steering motor 25 (the rotation of the ball screw nut 23) can be controlled by the controller 12 described in greater detail below. Although the steering motor 25 is used in the figures, other types of motors can also be used.

The housing 24 can include a steering arm 27 projecting rearwardly relative to the outboard motor 3 (upward in FIG. 2). The housing 24 can be connected to the steering bracket 13 via this arm 27. The arm 27 can be formed in triangle-like in a plan view, and connected to the steering bracket 13 by a connecting mechanism having a connecting pin 28 attached to the rear end and a long hole 29 of the steering bracket 13 that this connecting pin 28 fits into in a rotatable manner. However, other configurations can also be used.

A steering unit angle sensor 30 for detecting an actual angle of the main body 9 of the outboard motor according to the rotation of the ball screw nut 23 can be provided in this housing 24. The actual angle detecting device can be constructed with this steering unit angle sensor 30. In addition, as this steering unit angle sensor 30, for example, a so-called gap sensor may be used for detecting a large number of grooves (protrusion) formed on the outer peripheral surface of the shaft part that rotates together with the main body 9 of the outboard motor by changes of magnetic flux. However, other configurations can also be used.

In the steering unit 15 according some embodiments, the ball screw nut 23 rotates by the driving of the steering motor 25 and moves along the ball screw shaft 22. This action makes the steering lever 27 rotate the steering bracket 13 to the left or right, and the main body 9 of the outboard motor can thus be steered. However, other types of mechanisms and methods for steering can also be used.

The electric type steering device 2 can include, as shown in FIG. 1, a steering wheel 31 provided in an operator's area of the small watercraft 1, a steering angle sensor 32 for detecting a steering angle of the steering wheel 31, the controller 12 connected to the steering angle sensor 32, the steering unit 15 of each of the outboard motors 3 whose operations are controlled by the controller 12, and/or other devices.

Figure 4:
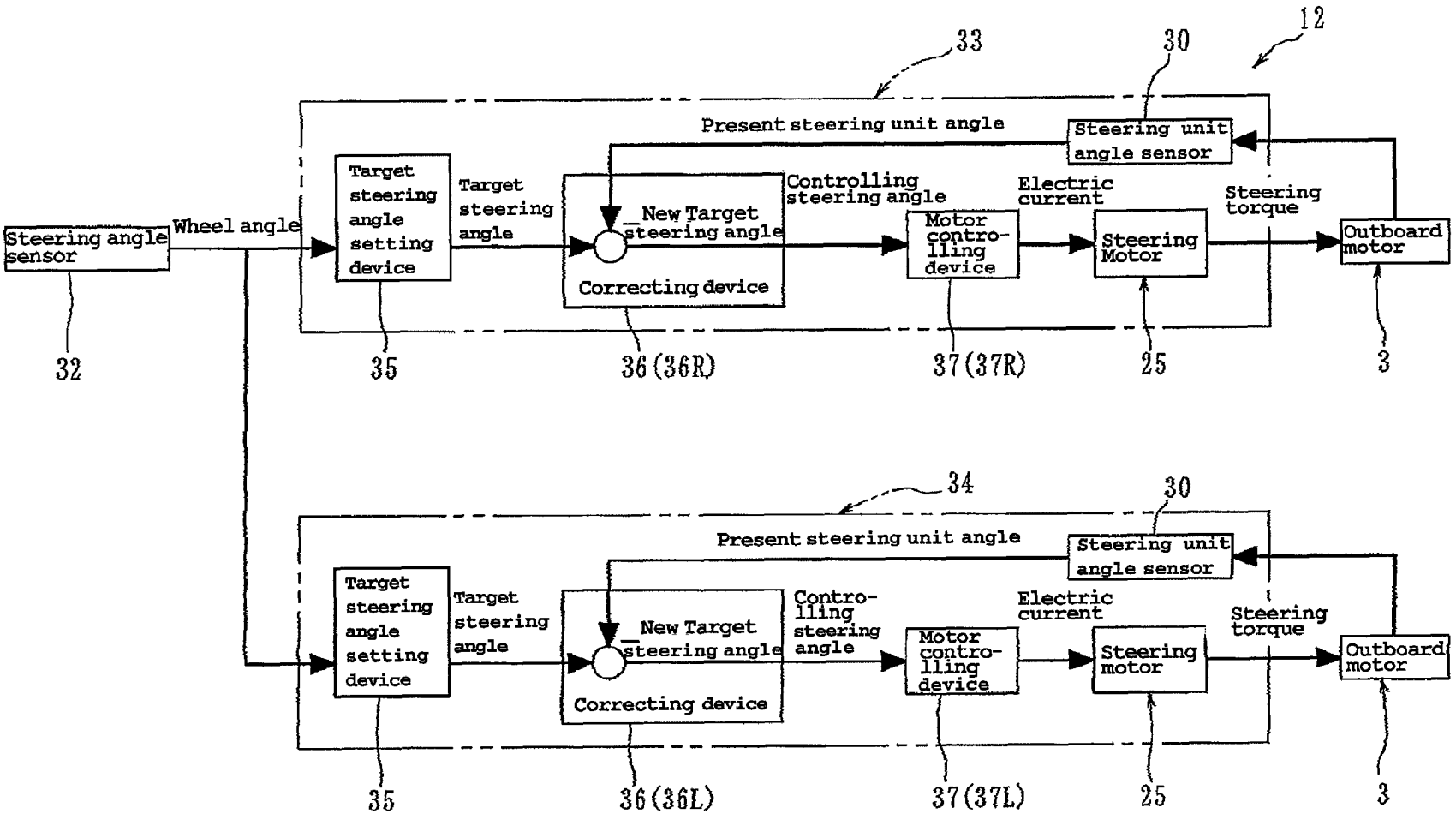
FIG. 4 is a block diagram showing a configuration of a control system that can be used with the electric steering device of FIG. 1.

The controller 12 can be, as shown in FIG. 4, configured so that it includes control modules 33, 34 for the respective outboard motors 3 (the respective steering units 15). Because these control modules 33, 34 can have the same or similar configurations, the control module 33 for steering the outboard motor 3R positioned on the right side of hull is fully described below. The same reference numerals are used to identify the same or similar components of the control circuit 34, however, the description is not repeated.

The control circuit 33 can include a target steering angle setting device 35 for obtaining a target steering angle of the outboard motor 3 by calculations based on a steering angle of the steering wheel 31 detected by the steering angle sensor 32, a correcting device 36 for correcting the target steering angle according to an actual steering angle detected by the steering unit angle sensor 30, and a motor controlling device 37 for controlling the steering motor 25 to operate so that the target steering angle corrected by the correcting device 36 agrees with the actual steering unit angle.

The correcting device 36 can be configured to obtain the difference between an actual (present) steering unit angle and a target steering angle of the outboard motor 3R positioned on the right side of the hull (this difference will be referred to as a first deviation hereinafter) and the difference between an actual (present) steering unit angle and a target steering angle of the outboard motor 3L positioned on the left side of the hull (this difference will be referred to as a second deviation hereinafter). A target steering angle can be corrected for each of the outboard motors 3R, 3L so that the first deviation and the second deviation are the same.

Figure 3:
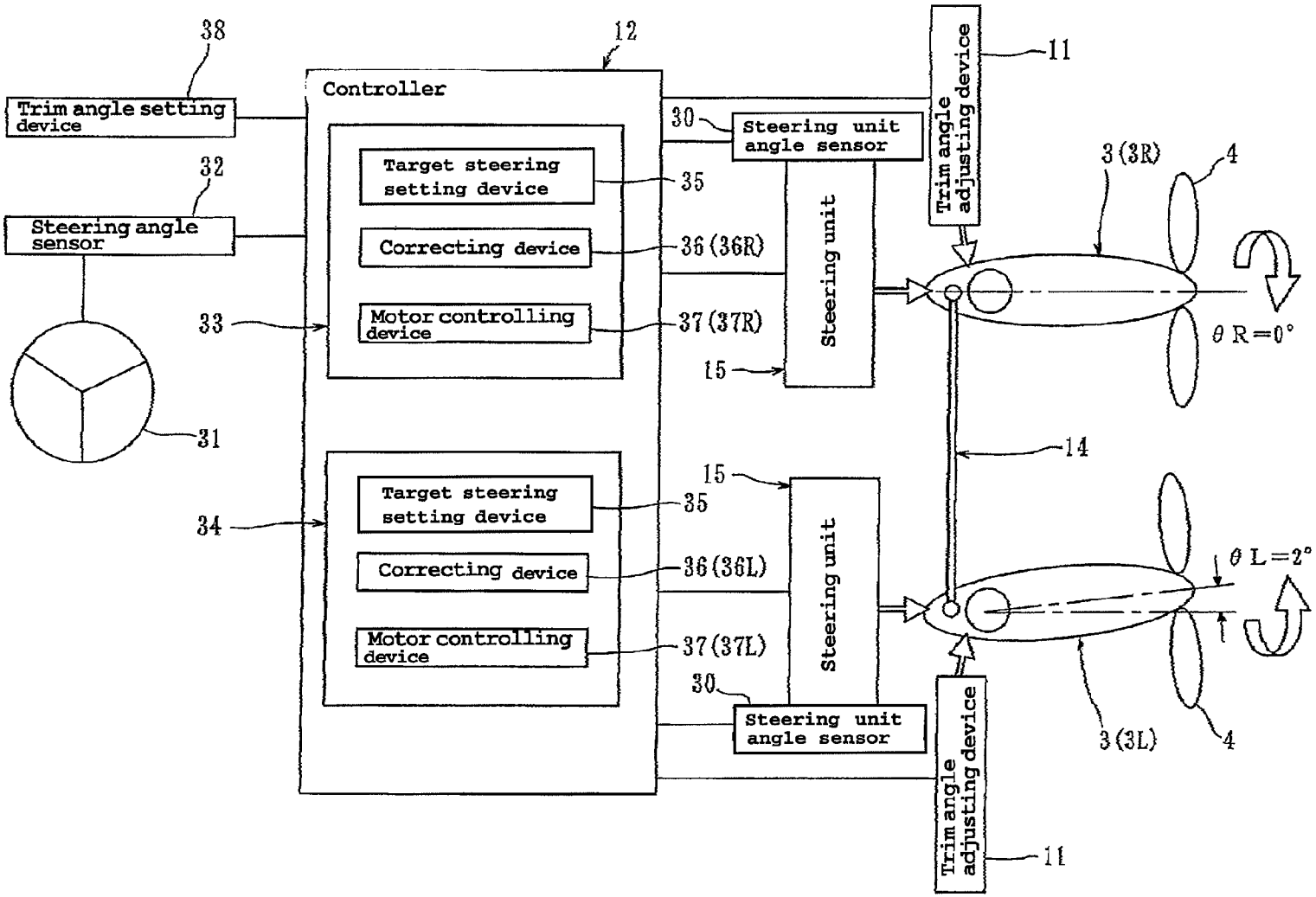
FIG. 3 is a block diagram showing a configuration that can be used with the electric type steering device of FIG. 1.

For example, as shown in FIG. 3, in case that a target value of 10° is given as a target steering angle when the actual steering unit angle θR of the outboard motor 3R positioned on the right side of the hull is 0° and the actual steering unit angle θL of the other outboard motor 3L is 2°, the correcting device prevents an excess of a steering angle over the upper limit by adjusting to the steering angle of the outboard motor that the deviation becomes smaller.

For example, in some embodiments with regard to the scenario described above, the correcting device 36 corrects the target steering angles for each of the outboard motors so that the deviation becomes 8°, a new target steering angle can be set at 8° for the outboard motors 3 on the right side of the hull, and a new target steering angle can be set at 10° for the other outboard motor 3. The actual steering unit angle of the outboard motor 3 can be detected by the steering unit angle sensor 30 provided in the steering unit 15 of each of the outboard motors 3.

In addition, a correcting value for a target steering angle of the outboard motors 3R, 3L can be, as mentioned above, obtained using the deviation of each of the outboard motors 3R, 3L, but also can be obtained as the difference between the average of actual angles of the outboard motors 3R, 3L the actual angle of each of the outboard motors 3R, 3L.

For example, if a steering angle θR of the outboard motor 3R positioned on the right side of the hull is 1° to the left and a steering angle θL of the outboard motor 3L positioned on the left side of the hull is 0°, the correcting device 36 obtains the average value of the steering angles, (θR+θL)/2, and sets target values to which the difference between this average value (0.5°) and the actual steering unit angle of each of the outboard motors (0.5°), (−0.5°) has been added as the correcting value.

That is, in case that a target steering angle obtained by the target steering angle setting device 35 is, for example, 15°, the correcting device 36 of the control circuit 33 for the right side outboard motor 3R subtracts a steering angle (0.5°) as the difference from the target steering angle (15°), and sets a new target steering angle (14.5°). The correcting device 36 of the control circuit 34 for the left side outboard motor 3L adds a steering angle (0.5°) as the difference to the target steering angle (15°), and sets a new target steering angle (15.5°).

In this case, the motor controlling device 37 of the control circuit 33 for the right side outboard motor 3R operates the steering motor 25 of the right side steering unit 15 so that the actual steering unit angle of the outboard motor 3R reaches 14.5°. Similarly, the motor controlling device 37 of the control circuit 34 for the left side outboard motor 3L operates the steering motor 25 of the left side steering unit 15 so that the actual steering unit angle of the outboard motor 3L reaches 15.5°.

The controller 12 according to some embodiments can be, as shown in FIG. 3, configured such that the trim angle adjusting devices 11, and a trim angle setting device 38 including a trim angle changing switch and other devices are connected to the controller 12 and the operations of the trim angle adjusting devices 11 are controlled to obtain trim angles set by the trim angle setting device 38.

The correcting device 36 of the controller 12 controls the trim angle adjusting device 11 and, at the same time, corrects the target steering angle corresponding to the trim angle when a control signal to change the trim angle can be sent from the trim angle setting device 38. That is, the target steering angle can be corrected so that the outboard motor 3 can be steered to the center in the width direction (for example, to the left for the right side outboard motor 3R) as the trim angle increases. With this correction, a change of only the trim angle of either outboard motor 3 of the two outboard motors 3 connected together by the connecting member 14 including a tie rod can be achieved.

In some embodiments, the trim angle detecting device can be formed with the trim angle setting device 38. In addition, in the case that a trim angle sensor can be mounted for detecting the magnitude of the trim angle of the main body of outboard motor 9 according to the displacement of the main body of the outboard motor 9 in the vertical direction, the target steering angle can be corrected using the data of the trim angle detected by the sensor.

Figure 5:
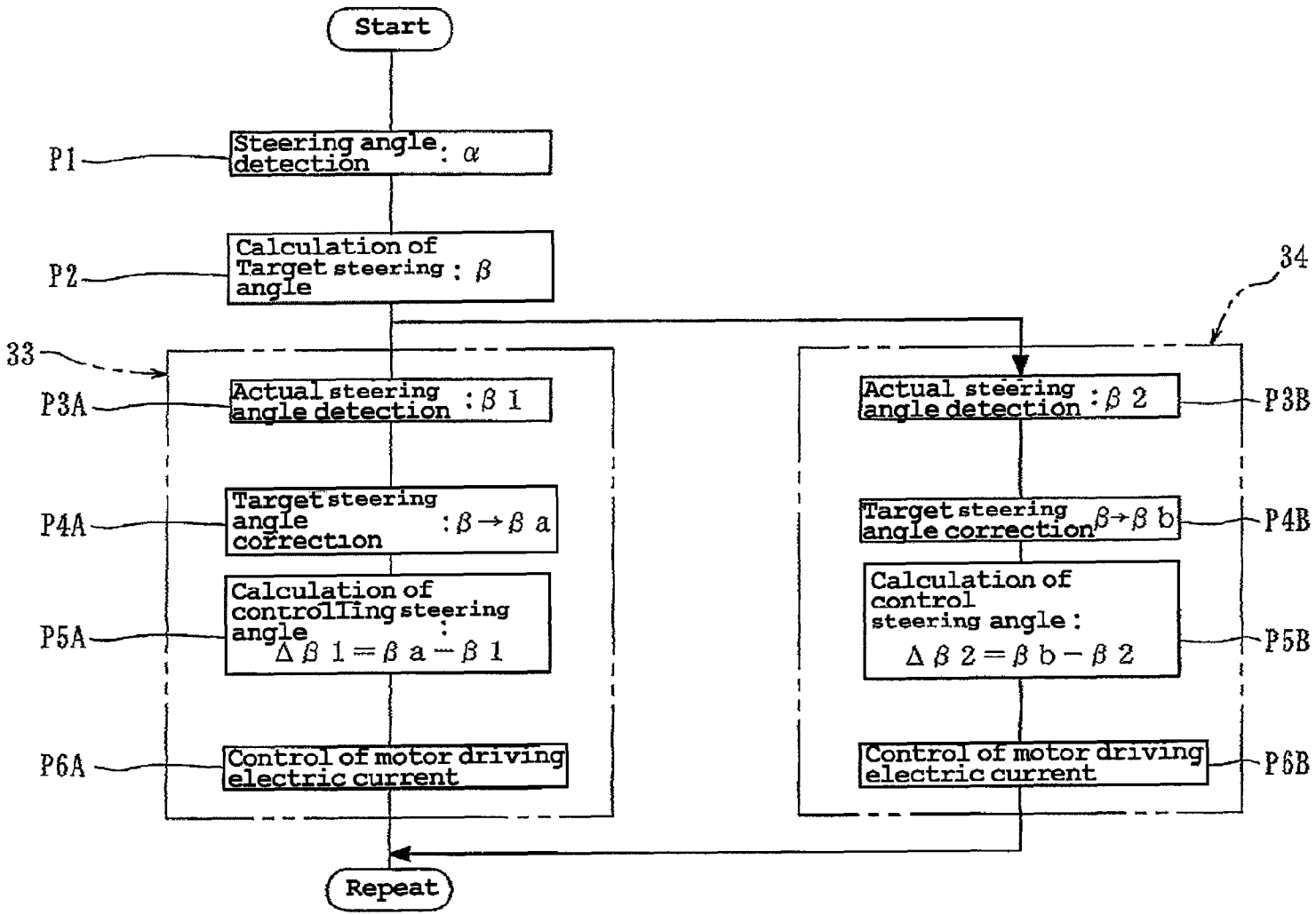
FIG. 5 is a flow chart illustrating a control routine that can be used with the electric type steering device of FIG. 1.

The operation of the controller 12 is described hereinafter with reference to the flow chart in FIG. 5. When the controller 12 controls a steered movement, the steering angle sensor 32 detects a steering angle (α) of the steering wheel 31 first in the step P1 of the flow chart shown in FIG. 5, and a target steering angle β can be calculated by the target steering angle setting device 35 in the step P2. The data indicating this target steering angle β can be sent to each of the correcting device 36R of the control circuit 33 and the correcting device 36L of the control circuit 34.

The correcting device 36R, 36L can detect the actual angles β1 and β2 of the outboard motors 3 by the steering unit angle sensors 30 in the steps P3A and P3B, respectively. The target steering angle β can be corrected according to the actual angles β1 and β2 and new target steering angles βa and βb can be set in the steps P4A and P4B, respectively.

Next, in the step P5A, the correcting device 36R can obtain a control steering angle Δβ1 which can be the difference between the target steering angle βa and the actual steering unit angle β1. The correcting device 36L can obtain Δβ2 which can be the difference between the target steering angle βb and the actual angle β2, in the step P5B.

Then, both the motor controlling devices 37R and 37L pass electric currents for controlling to the steering motors 25 so that the outboard motors are steered by the control steering angles in the steps P6A and P6B. The steering motors 25 are energized, and thereby the steering unit 15 steers the main body 9 of the outboard motors by the predetermined control steering angles. After energizing the steering motors 25 in such a manner, this control routine can be finished and the process returns to the step P1.

In the electric type steering device for outboard motors 2 configured in such a manner, the target steering angle set according to the steering displacement of the steering wheel 31 can be corrected by the correcting device 36 so that the target steering angle corresponds to the difference of steering angle of each outboard motor. Therefore, all the steering motors 25 operate with the same amount of movement without being affected by the difference between the angles of the outboard motors 3R, 3L. As such, the steering motors 25 are not affected by the changes in the trim angles either because the target steering angles can be corrected responding to the change of the trim angle of one of the outboard motors 3R, 3L.

Therefore, in some embodiments, no difference between amounts of operations of the steering motors 25 occurs and all the steering motors 25 can operate with appropriate electricity consumption even in the case that differences in actual steering unit angles occur between the outboard motors 3R, 3L such as the case that the lengths of the connecting members for connecting the outboard motors 3 somehow change.

In some embodiments, because the differences between the average of actual steering unit angles and the actual steering unit angles in correcting the target steering angle, the amounts of the difference can be made smaller comparing with the case that, for example, the difference between the maximum value and minimum value of the actual steering unit angles can be used as the difference between the actual steering unit angles. Therefore, according some embodiments, the difference between the steering displacement of the steering wheel 31 and the amount of operation of the steering motor 25 becomes small and the behavior of the hull follows the steering of the steering wheel 31 correctly.

Moreover, according to some embodiments, a tie rod with a simple structure can be used as the connecting member 14 because the target steering angles are corrected responding to the changes in the trim angles of the outboard motors 3. That is, in the case the trim angle of either one of the two outboard motors 3R, 3L can be changed, the target steering angle of this outboard motor 3 can be corrected, and the tie rod is not pulled with an excessive force.

In addition, in some embodiments, because forces in the lateral directions produced at the rotation of the propellers 4 are canceled due to the two outboard motors 3, the steering motors 25 do not need to be energized against the force while the watercraft is running.

Figure 6:
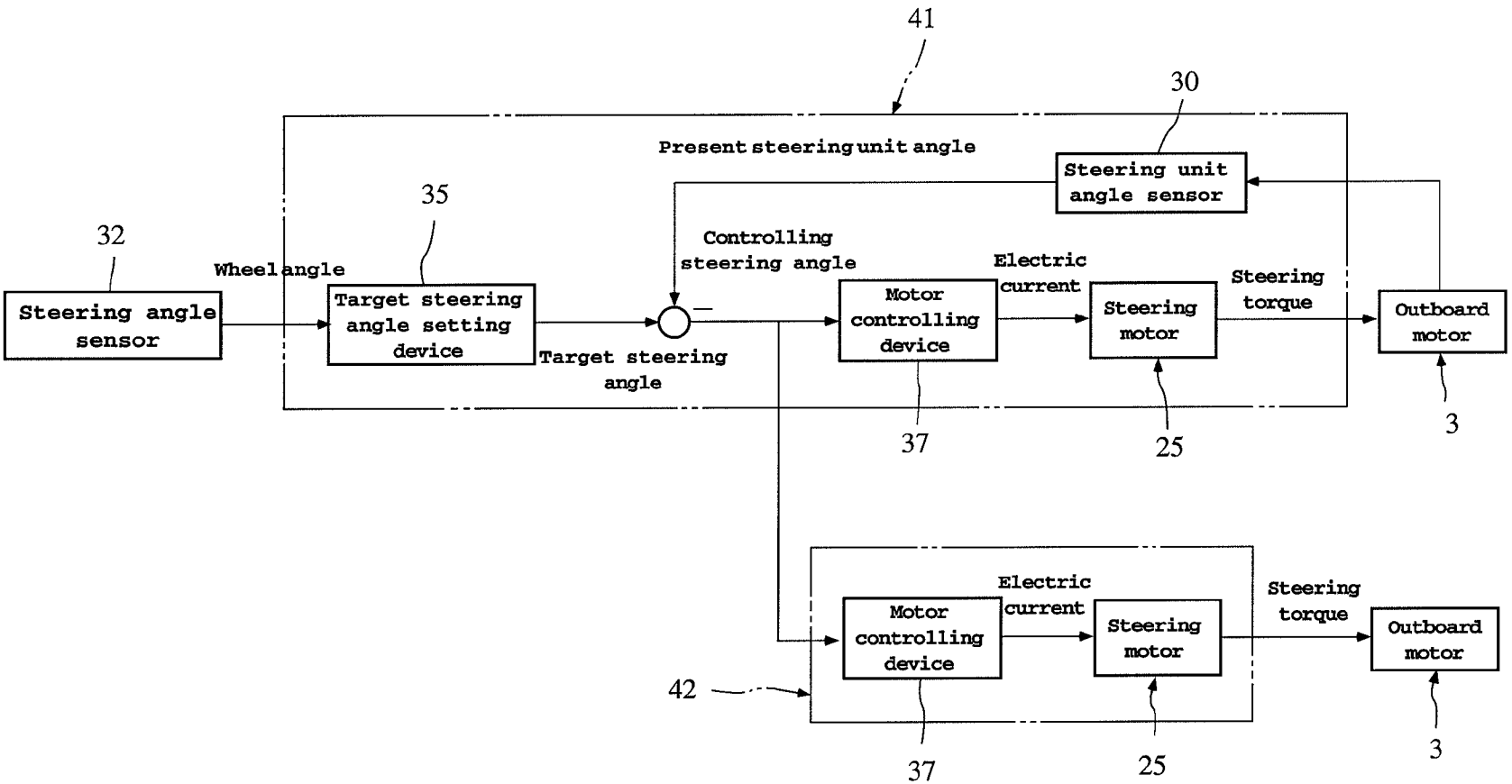
FIG. 6 is a block diagram showing another configuration of a control system that can be used with the electric type steering device of FIG. 1.
Figure 7:
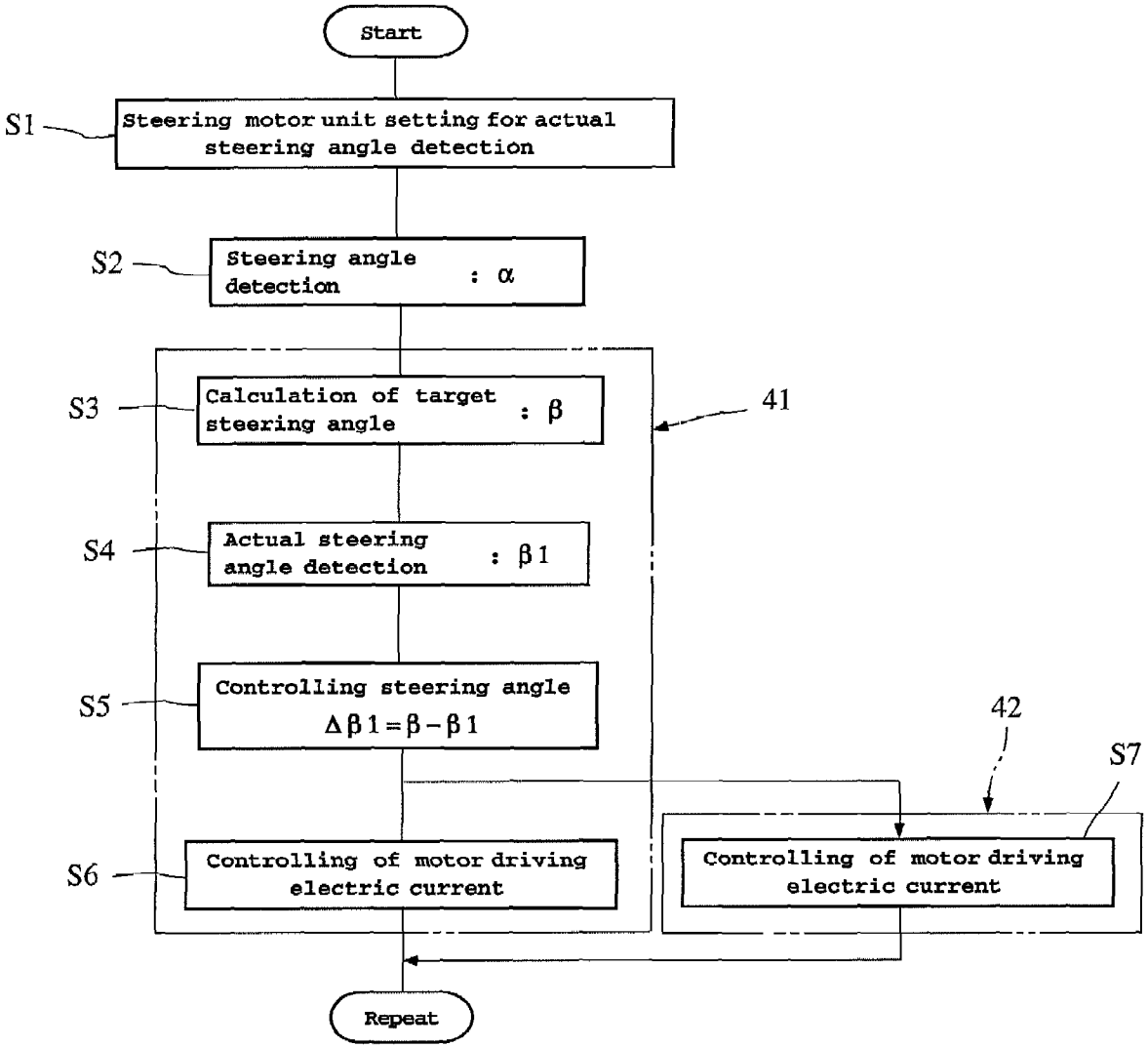
FIG. 7 is a flow chart illustrating a control routine that can be used with the electric type steering device of FIG. 1.

FIGS. 6 and 7 illustrate a modification of the steering device described above. In particular, FIG. 6 is a block diagram showing the configuration of a modified control system of the electric type steering device, and FIG. 7 is a flow chart illustrating a control routine that can be used with the modified control system of FIG. 6. In these figures, the same reference numerals are used to identify the same or similar components in FIGS. 1-5, and the detailed explanation is not repeated.

A controller 12 shown in FIG. 6 can include a control circuit 41 with a configuration such that some functions are omitted from the control circuits 33, 34 of FIG. 1-5 and a motor driving circuit 42 having only a motor controlling device 37 and a steering motor 25. However, other configurations can also be used.

The control circuit 41 can be for controlling the steering movement of one of the two outboard motors 3 predetermined to be a reference outboard motor. In some embodiments, the control circuit 41 can include a target steering angle setting device 35 configured to obtain a target steering angle of the reference outboard motor 3 by calculation based on a steering angle of the steering wheel 31 detected by a steering angle sensor 32, and the motor controlling device 37 for controlling to operate the steering motor 25 so that an actual angle detected by the steering unit angle sensor 30 agrees with the target steering angle.

The motor driving circuit 42 can be configured to control the steering movement of the other outboard motor 3 of the two outboard motors 3, and the motor controlling device 37 of the motor driving circuit 42 can be configured to control the steering motor 25 for the other outboard motor 3 so that a target steering angle obtained by the target steering angle setting device 35 of the control circuit 41 agrees with an actual steering unit angle detected by the steering unit angle sensor 30 for the reference outboard motor 3. That is, the motor controlling device 37 of the control circuit 41 and the motor controlling device 37 of the motor driving circuit 42 control to operate the respective steering motors 25 with the same amount of control.

The electric type steering device according some embodiments operates as shown in FIG. 7. First, the reference outboard motor 3 among the two outboard motors 3R, 3L can be determined in the step S1 of the flow chart shown in FIG. 7, and then a steering angle ($\alpha$) of the steering wheel 31 can be detected by the steering angle sensor 32 in the step S2.

Next, a target steering angle $\beta$ can be calculated by the target steering angle setting device 35 in the step S3, and an actual steering unit angle $\beta$1 of the reference outboard motor 3 can be detected by the steering unit angle sensor 30 in the step S4.

Then, a control steering angle $\Delta\beta$1, which can be the difference between the target steering angle $\beta$ and the actual steering unit angle $\beta$1 can be obtained in the step S5, and electric currents for controlling are passed respectively to the steering motor 25 for the reference outboard motor 3 and the steering motor 25 for the other outboard motor 3 so that they are steered only with the control steering angle $\Delta\beta$1 as shown in the steps S6 and S7. After energizing both the steering motors 25, 25 in such a manner, the process finishes this control routine and returns to the step S1.

Thereby, according to some embodiments, the operations of the two steering motors 25, 25 are controlled according to a steering unit angle of the reference outboard motor (e.g. 3R or 3L), and both the steering motors 25, 25 operate with the same amount of operation without being affected by the difference between the steering unit angles of the outboard motors 3. As such, controller of FIGS. 6 and 7 can achieve the same or equivalent steering control as that of FIGS. 1-5.

In the embodiments disclosed above, an example can be shown such that a steering unit 15 can be provided for each of the two outboard motors 3R, 3L. However, the numbers of the outboard motors 3 and the steering units 15, and the places where the steering units are connected can be properly changed as shown in FIGS. 8 through 13. FIGS. 8 through 13 are the figures for showing the examples of the connection of the steering units 15, and the same reference numerals are provided and an explanation in detail will not be repeated for the same or equivalent members explained in FIGS. 1 through 7 in a proper manner in these figures.

Figure 8:
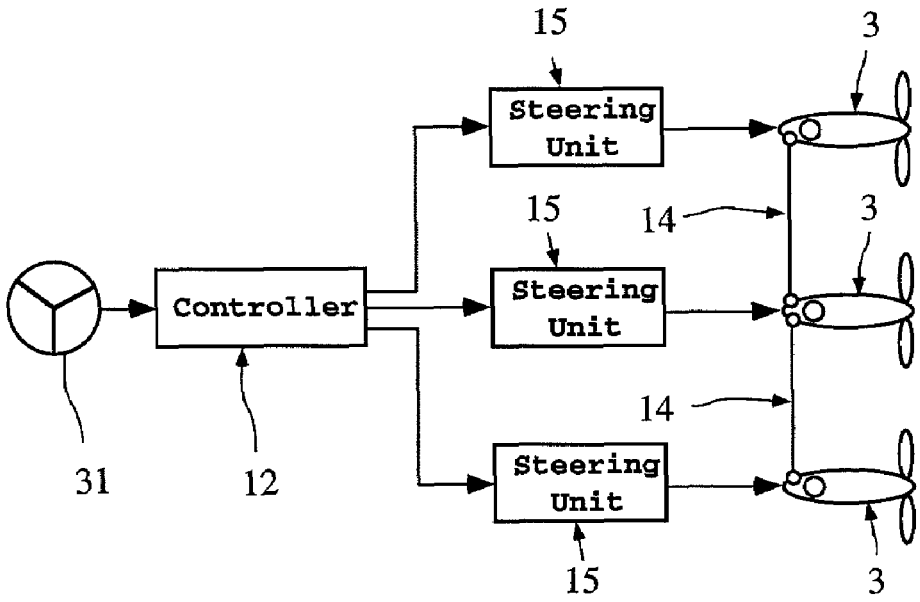
FIG. 8 is a figure showing an example of a connection of a steering unit that can be used with the electric type steering device of FIG. 1.

In the electric type steering devices for outboard motors 2 shown in FIG. 8, a steering unit 15 can be provided for each of the three outboard motors 3. In this configuration, for example, an effect equivalent to the case of the electric type steering device 2 described in the first and second embodiment with the setting such that the rotational direction of the propeller 4 of the outboard motor 3 in the middle can be opposite to the rotational direction of the propellers 4 of both the outside outboard motors 3.

Figure 9:
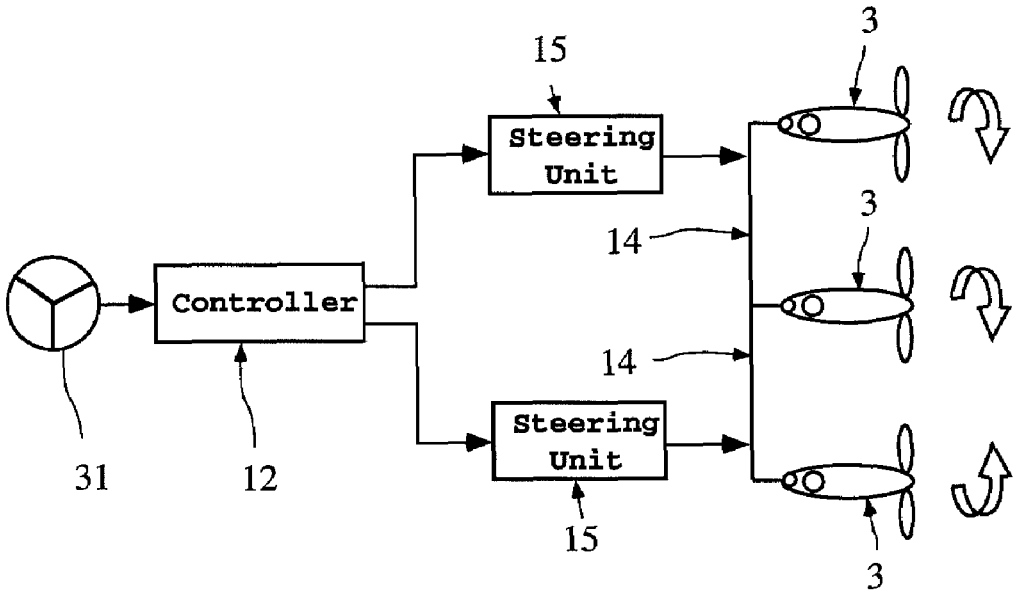
FIG. 9 is a figure showing an example of a connection of a steering unit that can be used with the electric type steering device of FIG. 1.

In the electric type steering devices for outboard motors 2 shown in FIG. 9, a steering unit 15 can be connected to each of the two connecting members 14, 14 connecting the three outboard motors 3. With this configuration, the number of the steering units 15 can be made less than the number of the outboard motors 3, and the cost can be lowered.

Figure 10:
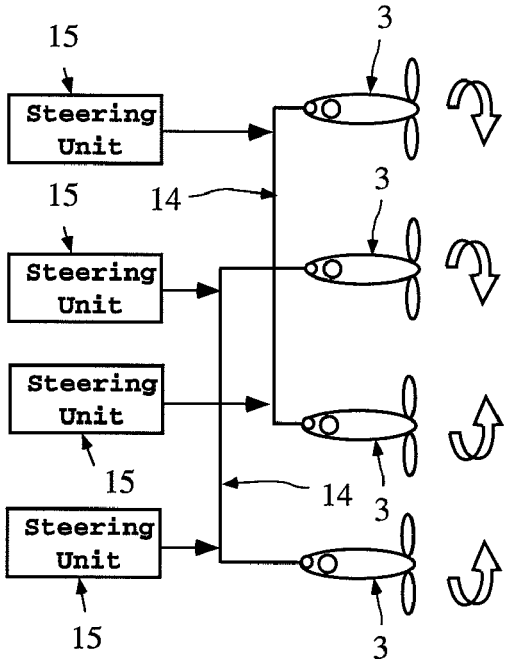
FIG. 10 is a figure showing an example of a connection of a steering unit that can be used with the electric type steering device of FIG. 1.
Figure 11:
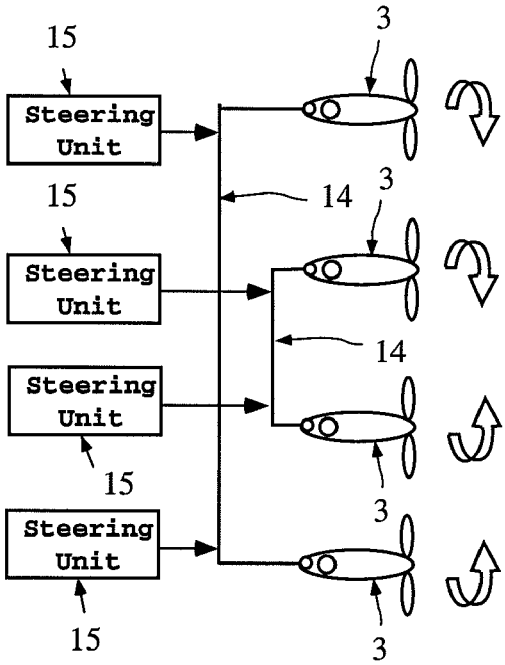
FIG. 11 is a figure showing an example of a connection of a steering unit that can be used with the electric type steering device of FIG. 1.

The electric type steering devices for outboard motors 2 shown in FIGS. 10 and 11 can be equipped with two pairs of outboard motor connecting system 51 constructed with two outboard motors 3, 3 whose propellers' rotational directions are opposite to each other and a connecting member 14 for connecting the outboard motors 3, 3 together, and a steering unit 15 can be provided for each of the outboard motors 3. In the mode shown in FIGS. 10 and 11, the rotational directions of the propellers 4 of the two outboard motors 3 positioned on the left side of the hull are the same, and the two outboard motors 3 positioned on the right side of the hull are formed so that the rotational directions of the propellers 4 are opposite to those of the other two outboard motors 3.

In the electric type steering devices for outboard motors 2 shown in FIG. 10, the outboard motor 3 positioned leftmost of the hull and the second outboard motor 3 from the right are connected together by the connecting member 14, and the remaining two outboard motors 3, 3 are connected together by the connecting member 14.

In the electric type steering devices for outboard motors 2 shown in FIG. 11, the two outboard motors 3, 3 positioned at both the ends in the width direction are connected together by the connecting member 14, and the remaining outboard motors 3, 3 are connected together by the connecting member 14. The configurations shown in FIGS. 10 and 11 can achieve an effect equivalent to that of the controller 12 of FIGS. 4 and 6.

Figure 12:
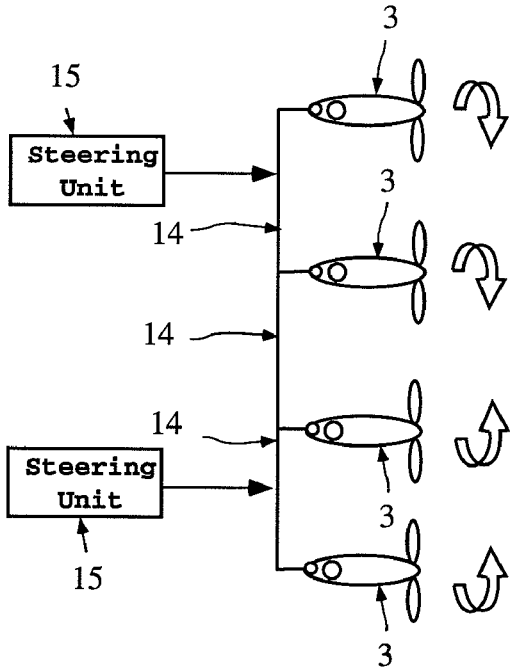
FIG. 12 is a figure showing an example of a connection of a steering unit that can be used with the electric type steering device of FIG. 1.
Figure 13:
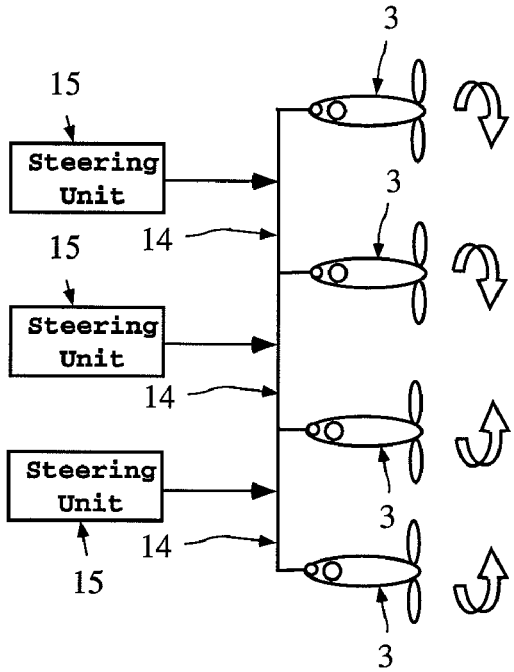
FIG. 13 is a figure showing an example of a connection of a steering unit that can be used with the electric type steering device of FIG. 1.

In the electric type steering devices for outboard motors 2 shown in FIG. 12, a steering unit 15 can be connected to each of the two outside connecting members 14 of the three connecting members 14 for connecting the four outboard motors 3, and, in the electric type steering devices for outboard motors 2 shown in FIG. 13, a steering unit 15 can be connected to each of the three connecting members 14 for connecting the four outboard motors. With the configuration shown in FIG. 12 or 13, the number of the steering units 15 can be made less than the number of the outboard motors 3, and thereby the cost can be lowered.

Figure 14:
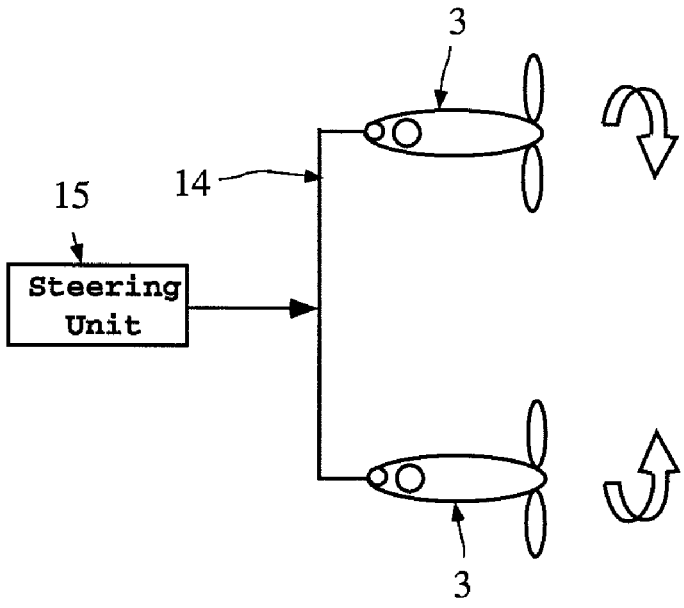
FIG. 14 is a figure showing an example of a connection of a steering unit that can be used with the electric type steering device of FIG. 1.
Figure 15:
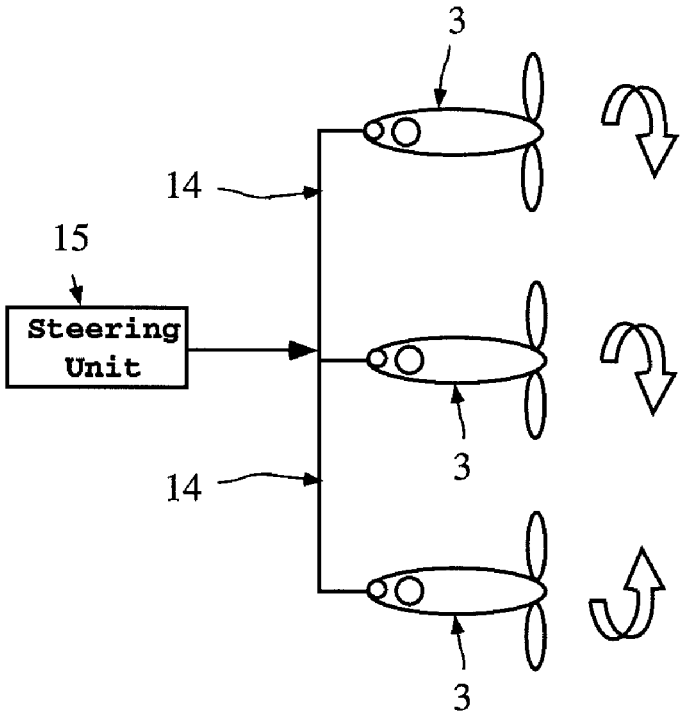
FIG. 15 is a figure showing an example of a connection of a steering unit that can be used with the electric type steering device of FIG. 1.
Figure 16:
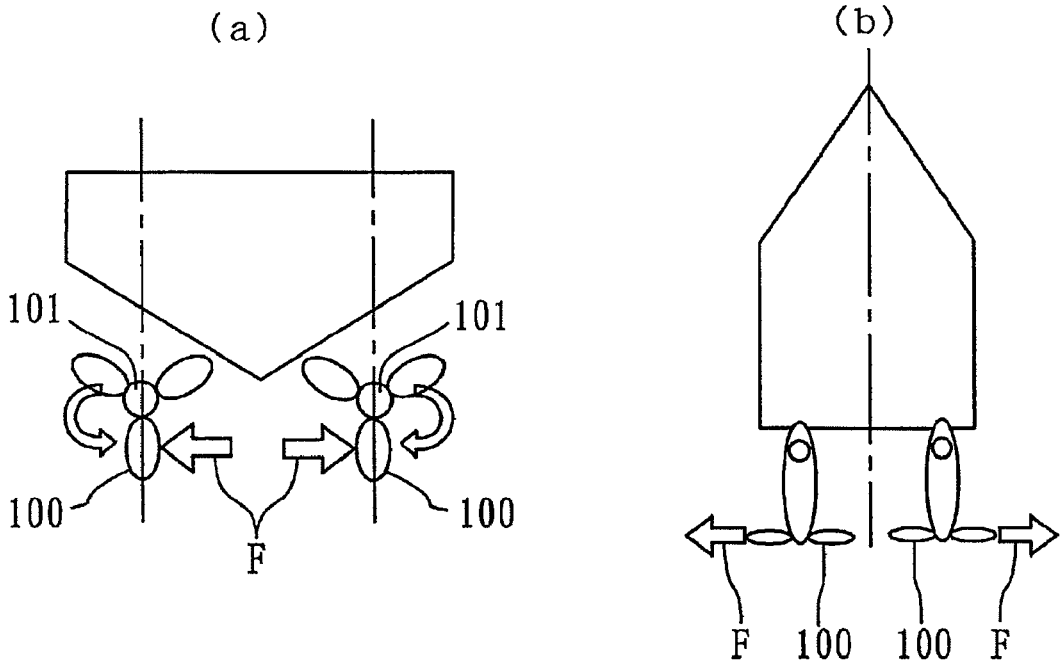
FIG. 16 is a schematic diagram for explaining a conventional steering device for outboard motors.
Figure 17:
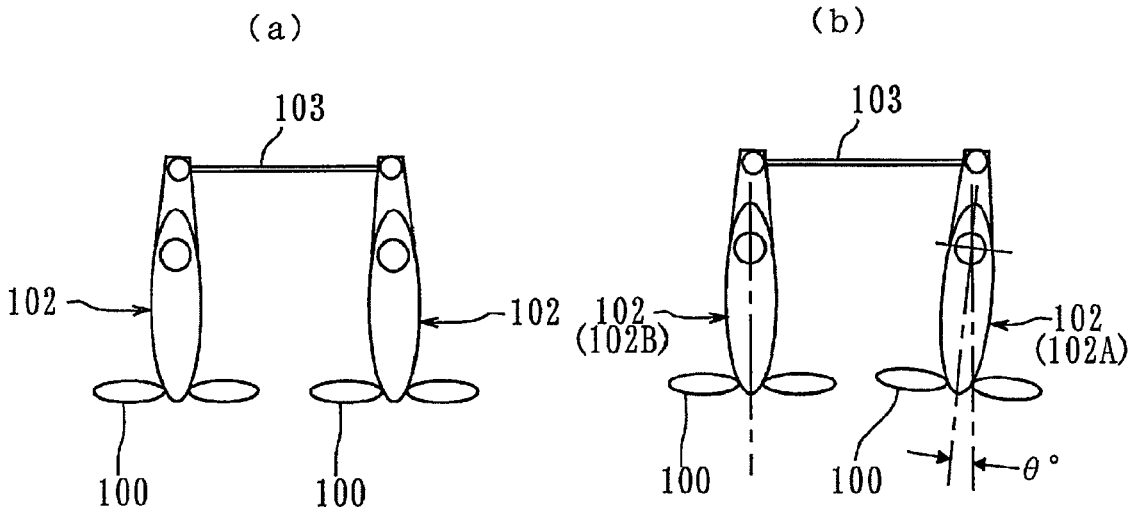
FIG. 17 is a schematic diagram for explaining a conventional steering device for outboard motors.

In addition, in the case that a plurality of the outboard motors are connected together so that they are linked together by the connecting members, the configuration can be applied such that one electric type steering unit can be connected there as shown in FIGS. 14 and 15. The steering unit 15 shown in FIG. 14 can be connected to the connecting member 14 for connecting the two outboard motors 3, 3 together, and the steering unit 15 shown in FIG. 15 can be connected to the connecting member 14 for connecting the three outboard motors 3, 3, 3 together.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An electric type steering device for a plurality outboard motors, comprising:

a steering wheel;

a connecting member for connecting outboard motors together so that the steering movements of a plurality of outboard motors are linked together;

a plurality of electric steering motors configured to steer the plurality of outboard motors;

a target steering angle setting device configured to obtain a target steering angle according to a steering displacement of the steering wheel and an actual steering unit angle detecting device configured to detect an actual steering unit angle of each of the outboard motors;

a correcting device configured to obtain a difference between actual steering unit angles of at least two of the plurality of outboard motors, to correct a target steering angle of each outboard motor according to this difference, and to obtain a target steering angle of each outboard motor; and a motor controlling device configured to control the electric steering motors so that the target steering angle of each of the outboard motors agrees with the actual steering unit angle.

2. The electric type steering device according to claim 1, wherein differences between actual steering unit angles of the outboard motors are differences between an average of actual steering unit angles of all outboard motors and an actual angle of each outboard motor.

3. The electric type steering device according to claim 1 additionally comprising a trim angle detecting device configured to detect a trim angle of each outboard motor, wherein the correcting device is configured to correct a target steering angle of each outboard motor so that each target steering angle agrees with the size of the trim angle detected by the trim angle detecting device.

4. The electric type steering device according to claim 2 additionally comprising a trim angle detecting device configured to detect a trim angle of each outboard motor, wherein the correcting device is configured to correct a target steering angle of each outboard motor so that each target steering angle agrees with a size of the trim angle detected by the trim angle detecting device.

5. The electric type steering device according to claim 1, wherein the connecting member connects at least two outboard motors whose propellers rotate in different directions together in a forward propulsion mode, and wherein an electric steering motor is provided on each of the outboard motors.

6. The electric type steering device according to claim 2, wherein the connecting member connects at least two outboard motors whose propellers rotate in different directions together in a forward propulsion mode, and wherein an electric steering motor is provided on each of the outboard motors.

7. The electric type steering device according to claim 3, wherein the connecting member connects at least two outboard motors whose propellers rotate in different directions together in a forward propulsion mode, and wherein an electric steering motor is provided on each of the outboard motors.

8. The electric type steering device according to claim 1, wherein the connecting member connects at least two outboard motors whose propellers rotate in different directions together, a plurality of pairs of outboard motors connecting system including the connecting member and a plurality of outboard motors are installed, and wherein an electric steering motor is provided on each of the connected outboard motors.

9. The electric type steering device according claim 1, wherein a connecting assembly including the connecting member connects at least three outboard motors together, and an electric steering motor is provided on each of at least two of the plurality of outboard motors.

10. The electric type steering device according claim 2, wherein a connecting assembly including the connecting member connects at least three outboard motors together, and an electric steering motor is provided on each of at least two of the plurality of outboard motors.

11. An electric type steering device for a plurality of outboard motors, comprising:

a steering wheel;

a connecting member connecting a plurality of outboard motors together so that the steering movements of the plurality of outboard motors are linked;

a plurality of electric steering motors configured to steer the plurality of outboard motors;

a target steering angle setting device configured to obtain a target steering angle according to a steering displacement of the steering wheel;

an actual steering unit angle detecting device configured to detect an actual steering unit angle of a predetermined reference outboard motor of the plurality of outboard motors; and a motor controlling device configured to obtain a controlling steering angle which is the difference between an actual steering unit angle detected by the actual steering unit angle detecting device and the target steering angle, and to operate all electric steering motors only by the controlling steering angle.

12. The electric type steering device according to claim 11, wherein the connecting member connects at least two outboard motors whose propellers rotate in different directions together in a forward propulsion mode, and wherein an electric steering motor is provided on each of the outboard motors.

13. The electric type steering device according to claim 11, wherein the connecting member connects at least two outboard motors whose propellers rotate in different directions together, a plurality of pairs of outboard motors connecting system including the connecting member and a plurality of outboard motors are installed, and wherein an electric steering motor is provided on each of the connected outboard motors.

14. The electric type steering device according claim 11, wherein a connecting assembly including the connecting member connects at least three outboard motors together, and an electric steering motor is provided on each of at least two of the plurality of outboard motors.

15. The electric type steering device according to claim 1, wherein the plurality of electric steering motors comprises at least first and second electric steering motors connected to first and second of the at least two outboard motors, respectively, and where in the first and second electric steering motors are configured to change the steering angle of the first and second outboard motors relative to first and second clamp brackets, respectively.

16. The electric type steering device according to claim 1, wherein the connecting member consists of a rod.

* * * * *

UNITED STATES PATENT AND TRADEMARK OFFICE

CERTIFICATE OF CORRECTION

PATENT NO. : 7,527,537 B2
APPLICATION NO. : 11/593393
DATED : May 5, 2009
INVENTOR(S) : Makoto Mizutani It is certified that error appears in the above-identified patent and that said Letters Patent is hereby corrected as shown below:

In Column 11, Line 62, in Claim 2, please change "actual" to --actual steering--.

In Column 12, Line 2, in Claim 3, please change "the size" to --a size--.

Signed and Sealed this

Eleventh Day of May, 2010

David J. Kappos

David J. Kappos
*Director of the United States Patent and Trademark Office*